US009908338B2

(12) United States Patent
Koshikawa et al.

(10) Patent No.: US 9,908,338 B2
(45) Date of Patent: Mar. 6, 2018

(54) LIQUID STORAGE BOTTLE, LIQUID STORAGE BOTTLE PACKAGE, AND METHOD OF MANUFACTURING LIQUID STORAGE BOTTLE PACKAGE

(71) Applicant: CANON KABUSHIKI KAISHA, Tokyo (JP)

(72) Inventors: Hiroshi Koshikawa, Yokohama (JP); Yasuo Kotaki, Yokohama (JP); Kenta Udagawa, Tokyo (JP); Wataru Takahashi, Yokohama (JP); Koichi Kubo, Yokohama (JP); Naozumi Nabeshima, Tokyo (JP); Soji Kondo, Yokohama (JP); Kazuya Yoshii, Yokohama (JP); Kenichi Kanno, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/274,806

(22) Filed: Sep. 23, 2016

(65) Prior Publication Data

US 2017/0120606 A1 May 4, 2017

(30) Foreign Application Priority Data

Oct. 30, 2015 (JP) ..... 2015-214403

(51) Int. Cl.
*B41J 2/175* (2006.01)
*B41J 29/02* (2006.01)
(Continued)

(52) U.S. Cl.
CPC ..... *B41J 2/17559* (2013.01); *B41J 2/17506* (2013.01); *B41J 2/17509* (2013.01);
(Continued)

(58) Field of Classification Search
CPC ..... B65D 41/0428; B65D 41/0471; B65D 41/265; B65D 11/04; B65D 51/18; B65D 11/1611; B41J 2/1754
See application file for complete search history.

(56) References Cited

U.S. PATENT DOCUMENTS 774,014 A * 11/1904 Wilson ..... B65D 41/0442 215/337
3,857,509 A * 12/1974 Baldwin ..... B65D 41/0414 215/329

(Continued)

FOREIGN PATENT DOCUMENTS

| | | |
|---|---|---|
| JP | 3289778 | 6/2002 |
| JP | 4321565 | 8/2009 |
| JP | 2014-012375 | 1/2014 |

OTHER PUBLICATIONS

U.S. Appl. No. 15/272,026, filed Sep. 21, 2016.

(Continued)

*Primary Examiner* — Stephen Meier
*Assistant Examiner* — John P Zimmermann
(74) *Attorney, Agent, or Firm* — Fitzpatrick, Cella, Harper & Scinto

(57) ABSTRACT

Provided is a liquid storage bottle capable of suppressing a decrease in degree of internal pressure reduction with a simple configuration. The liquid storage bottle includes: a main body portion configured to store a liquid; a nozzle portion configured to discharge the liquid stored in the main body portion; a cap mounted on the nozzle portion; a space portion formed between the nozzle portion and the cap; and a communicating portion configured to allow the space portion to communicate with outside of the liquid storage bottle. The nozzle portion includes a contact portion which comes into contact with the cap in a state in which the cap is mounted on the nozzle portion, and the communicating (Continued)

portion is a groove portion formed by cutting out a part of the contact portion.

17 Claims, 5 Drawing Sheets

(51) Int. Cl.
*B41J 29/13* (2006.01)
*B65D 51/16* (2006.01)

(52) U.S. Cl.
CPC ..... *B41J 2/17536* (2013.01); *B41J 29/02* (2013.01); *B41J 29/13* (2013.01); *B65D 51/1611* (2013.01)

(56) References Cited

U.S. PATENT DOCUMENTS 4,838,491 A * 6/1989 Bennett ..... B05B 5/1691 239/690
5,425,478 A 6/1995 Kotaki et al. ..... 222/501
5,430,471 A 7/1995 Nakajima et al. ..... 347/87
5,567,373 A 10/1996 Sato et al. ..... 264/112
5,583,549 A 12/1996 Ujita et al. ..... 347/86
5,584,420 A * 12/1996 Awada ..... G01F 11/288 222/153.09
5,589,862 A 12/1996 Ujita et al. ..... 347/87
5,608,437 A 3/1997 Iwata et al. ..... 347/86
5,619,237 A 4/1997 Inoue et al. ..... 347/86
5,619,239 A 4/1997 Kotaki et al. ..... 347/86
5,742,310 A 4/1998 Kotaki ..... 347/86
5,781,213 A 7/1998 Ujita et al. ..... 347/86
5,805,188 A 9/1998 Nakajima et al. ..... 347/87
5,815,184 A 9/1998 Ujita et al. ..... 347/87
5,852,457 A 12/1998 Kotaki et al. ..... 347/86
5,929,885 A 7/1999 Nakajima et al. ..... 347/87
5,988,804 A 11/1999 Kotaki et al. ..... 347/87
6,070,974 A 6/2000 Kotaki et al. ..... 347/86
6,116,722 A 9/2000 Sato et al. ..... 347/85
6,145,972 A 11/2000 Udagawa et al. ..... 347/86
6,145,975 A 11/2000 Kotaki et al. ..... 347/87
6,170,939 B1 1/2001 Ujita et al. ..... 347/86
6,234,618 B1 5/2001 Yamamoto et al. ..... 347/86
6,243,116 B1 6/2001 Kotaki et al. ..... 347/86
6,244,695 B1 6/2001 Udagawa ..... 347/86
6,247,598 B1 6/2001 Hosaka et al. ..... 206/723
6,293,663 B1 9/2001 Koshikawa et al. ..... 347/86
6,336,709 B1 1/2002 Inoue et al. ..... 347/49
6,338,546 B1 1/2002 Kotaki et al. ..... 347/49
6,350,025 B1 2/2002 Morita et al. ..... 347/86
6,361,158 B1 3/2002 Inoue et al. ..... 347/86
6,382,783 B1 5/2002 Hayashi et al. ..... 347/85
6,382,786 B2 5/2002 Iwanaga et al. ..... 347/86
6,390,601 B1 5/2002 Morita et al. ..... 347/49
6,390,612 B1 5/2002 Kotaki et al. ..... 347/85
6,402,298 B1 6/2002 Nanjo et al. ..... 347/49
6,416,173 B2 7/2002 Kishida et al. ..... 347/86
6,419,349 B1 7/2002 Iwanaga et al. ..... 347/86
6,419,350 B1 7/2002 Abe et al. ..... 347/86
6,421,623 B1 7/2002 Furukawa et al. ..... 702/100
6,443,567 B1 9/2002 Hayashi et al. ..... 347/85
6,450,631 B1 9/2002 Hayashi et al. ..... 347/86
6,454,400 B1 9/2002 Morita et al. ..... 347/86
6,471,343 B1 10/2002 Shimizu et al. ..... 347/85
6,505,923 B1 1/2003 Yamamoto et al. ..... 347/85
6,511,167 B1 1/2003 Kitabatake et al. ..... 347/86
6,527,381 B1 3/2003 Udagawa et al. ..... 347/86
6,530,654 B2 3/2003 Kitabatake et al. ..... 347/86
6,540,342 B2 4/2003 Koshikawa et al. ..... 347/86
6,543,886 B1 4/2003 Hattori et al. ..... 347/85
6,550,898 B2 4/2003 Hayashi et al. ..... 347/85
6,598,963 B1 7/2003 Yamamoto et al. ..... 347/85
6,623,104 B1 9/2003 Kotaki et al. ..... 347/49
6,652,949 B2 11/2003 Iwanaga et al. ..... 428/65.9
6,655,542 B2 12/2003 Koshikawa et al. ..... 220/661
6,702,427 B2 3/2004 Shimizu et al. ..... 347/50
6,705,715 B2 3/2004 Morita et al. ..... 347/87
6,709,092 B2 3/2004 Hayashi et al. ..... 347/86
6,712,458 B2 3/2004 Hatasa et al. ..... 347/86
6,719,415 B1 4/2004 Hattori et al. ..... 347/86
6,719,416 B2 4/2004 Anma et al. ..... 347/86
6,742,857 B2 6/2004 Koshikawa et al. ..... 347/19
6,742,881 B2 6/2004 Kotaki et al. ..... 347/86
6,755,515 B2 6/2004 Usui et al. ..... 347/86
6,796,645 B2 9/2004 Hayashi et al. ..... 347/86
6,805,434 B2 10/2004 Hayashi et al. ..... 347/85
6,824,258 B2 11/2004 Yamamoto et al. ..... 347/86
6,827,431 B2 12/2004 Kitabatake et al. ..... 347/86
6,851,798 B2 2/2005 Koshikawa et al. ..... 347/85
6,863,762 B2 3/2005 Sanada et al. ..... 156/180
6,869,158 B2 3/2005 Kojima et al. ..... 347/19
6,877,847 B2 4/2005 Hayashi et al. ..... 347/86
6,877,848 B2 4/2005 Shimizu et al. ..... 347/86
6,916,085 B2 7/2005 Kotaki et al. ..... 347/49
6,921,161 B2 7/2005 Morita et al. ..... 347/86
6,942,326 B2 9/2005 Hayashi et al. ..... 347/86
6,966,631 B2 11/2005 Matsuo et al. ..... 347/49
7,111,931 B2 9/2006 Amma et al. ..... 347/86
7,118,194 B2 10/2006 Matsuo et al. ..... 347/49
7,125,109 B2 10/2006 Watanabe et al. ..... 347/86
7,134,747 B2 11/2006 Hayashi et al. ..... 347/86
7,165,829 B2 1/2007 Hayashi et al. ..... 347/49
7,213,727 B2 * 5/2007 Kokubo ..... B65D 47/0838 215/320
7,350,910 B2 4/2008 Amma et al. ..... 347/86
7,384,116 B2 6/2008 Kotaki et al. ..... 347/19
7,396,118 B2 7/2008 Ogawa et al. ..... 347/87
7,401,909 B2 7/2008 Inoue et al. ..... 347/86
7,407,274 B2 8/2008 Inoue et al. ..... 347/86
7,407,275 B2 8/2008 Inoue et al. ..... 347/86
7,434,921 B2 10/2008 Udagawa ..... 347/85
7,581,808 B2 9/2009 Ishizawa et al. ..... 347/19
7,735,984 B2 6/2010 Iijima et al. ..... 347/86
7,854,499 B2 12/2010 Udagawa ..... 347/86
7,914,137 B2 3/2011 Inoue et al. ..... 347/86
7,926,927 B2 4/2011 Kotaki et al. ..... 347/86
7,950,790 B2 5/2011 Kubo et al. ..... 347/86
8,002,397 B2 8/2011 Udagawa et al. ..... 347/86
8,020,978 B2 9/2011 Ogawa et al. ..... 347/86
8,047,641 B2 11/2011 Nanjo et al. ..... 347/86
8,087,762 B2 1/2012 Takemura et al. ..... 347/85
8,109,617 B2 2/2012 Kotaki et al. ..... 347/86
8,136,930 B2 3/2012 Anma et al. ..... 347/86
8,205,974 B2 6/2012 Ogura et al. ..... 347/86
8,313,185 B2 11/2012 Hatasa et al. ..... 347/92
8,322,807 B2 12/2012 Seki et al. ..... 347/6
8,425,022 B2 4/2013 Inoue et al. ..... 347/86
8,469,498 B2 6/2013 Ohashi et al. ..... 347/86
8,485,642 B2 7/2013 Hayashi et al. ..... 347/49
8,529,037 B2 9/2013 Miyashita et al. ..... 347/86
8,550,607 B2 10/2013 Inoue et al. ..... 347/86
8,770,730 B2 7/2014 Nanjo et al. ..... 347/86
8,770,731 B2 7/2014 Miyashita et al. ..... 347/86
8,960,869 B2 2/2015 Takada et al. ..... 347/86
9,016,842 B2 4/2015 Miyashita et al. ..... 347/86
9,278,540 B2 3/2016 Seki et al. ..... B41J 2/17513
9,333,758 B2 5/2016 Koshikawa et al. . B41J 2/17556
9,375,938 B2 6/2016 Kondo et al. ..... B41J 2/17513
2001/0048457 A1 * 12/2001 Hara ..... B41J 2/17503 347/86
2002/0113853 A1 8/2002 Hattori et al. ..... 347/86
2003/0038867 A1 2/2003 Yamamoto et al. ..... 347/86
2003/0043241 A1 3/2003 Hattori et al. ..... 347/86
2003/0227521 A1 * 12/2003 Pan ..... B41J 2/17546 347/85
2004/0246304 A1 12/2004 Takahashi et al. ..... 347/49
2005/0007420 A1 1/2005 Ogawa et al. ..... 347/50
2005/0211734 A1 * 9/2005 Spada ..... B65D 41/0428 222/420
2006/0016511 A1 * 1/2006 Chantalat ..... A23L 2/54 141/64
2009/0278900 A1 11/2009 Kondo et al. ..... 347/85
2013/0050310 A1 2/2013 Seki et al. ..... 347/6
2015/0343793 A1 12/2015 Takada et al. ..... B41J 2/17556

(56) References Cited

U.S. PATENT DOCUMENTS

| | | | | |
|---|---|---|---|---|
| 2015/0352851 | A1 | 12/2015 | Shiba et al. | B41J 2/17513 |
| 2016/0052290 | A1 | 2/2016 | Takahashi et al. | B41J 2002/17579 |
| 2016/0200113 | A1 | 7/2016 | Nanjo et al. | B41J 2/175 |
| 2016/0200114 | A1 | 7/2016 | Nanjo et al. | B41J 2/17553 |

OTHER PUBLICATIONS

U.S. Appl. No. 15/294,406, filed Oct. 14, 2016.
U.S. Appl. No. 15/288,879, filed Oct. 7, 2016.
U.S. Appl. No. 15/294,442, filed Oct. 14, 2016.
U.S. Appl. No. 15/332,604, filed Oct. 24, 2016.
U.S. Appl. No. 15/338,031, filed Oct. 28, 2016.

* cited by examiner

LIQUID STORAGE BOTTLE, LIQUID STORAGE BOTTLE PACKAGE, AND METHOD OF MANUFACTURING LIQUID STORAGE BOTTLE PACKAGE

BACKGROUND OF THE INVENTION

Field of the Invention

The present invention relates to a liquid storage bottle, a liquid storage bottle package, and a method of manufacturing the liquid storage bottle package.

Description of the Related Art

In a liquid tank that is used in a liquid ejection apparatus such as an inkjet printer, there is a liquid tank having an inlet through which liquid is charged and being capable of refilling the liquid tank with liquid through the inlet from a separately prepared liquid refilling container (liquid storage bottle). In a pressurized state in which an internal pressure of the liquid refilling container is higher than the atmospheric pressure, when a cap of the liquid refilling container is opened, the liquid in the liquid refilling container may be splashed to contaminate a user's hand and a periphery thereof. Therefore, it is desired that the liquid refilling container be in a pressure-reduced state in which an internal pressure is lower than the atmospheric pressure.

In Japanese Patent Application Laid-Open No. 2014-12375, there is disclosed a method of bringing an inside of an ink container into a pressure-reduced state by closing an opening in a state in which the ink container is squeezed, and restoring an original shape of the container with elasticity thereof when the ink container is brought out of the unsqueezed state.

SUMMARY OF THE INVENTION

According to one aspect of the present invention, provided is a liquid storage bottle, including: a main body portion configured to store a liquid; a nozzle portion configured to discharge the liquid stored in the main body portion; a cap mounted on the nozzle portion; a space portion formed between the nozzle portion and the cap; and a communicating portion configured to allow the space portion to communicate with outside of the liquid storage bottle, in which the nozzle portion includes a contact portion which comes into contact with the cap in a state in which the cap is mounted on the nozzle portion, and the communicating portion is a groove portion formed by cutting out a part of the contact portion.

Further features of the present invention will become apparent from the following description of exemplary embodiments with reference to the attached drawings.

DESCRIPTION OF THE EMBODIMENTS

As in Japanese Patent Application Laid-Open No. 2014-12375, in a case where the ink container is accommodated in a bag, and the inside of the ink container is brought into the pressure-reduced state, a pressure-reduced space has a small inherent volume, and hence a film forming the bag may have flexure (creep) when the bag is left to stand for a long period of time or placed in a high temperature environment. As a result, the degree of pressure reduction in the bag is easily decreased.

In this regard, in Japanese Patent No. 3289778, there is disclosed a technology of forming recesses in a surface of a cover configured to cover an opening of an ink cartridge main body having ink storing chambers, and using each recess as a pressure-reduced space configured to accumulate negative pressure for deaeration when packing is performed in a pressure-reduced state. Further, in Japanese Patent No. 4321565, there is disclosed that a pressure-reduced space configured to accumulate negative pressure is arranged in an ink tank when the ink tank is packed in a pressure-reduced state. Each of the pressure-reduced spaces allows the degree of deaeration of ink to be maintained for a long period of time by increasing the volume of the pressure-reduced space in a package. In a case where the ink container disclosed in Japanese Patent Application Laid-Open No. 2014-12375 is to be provided with such a pressure-reduced space, there can be conceived to reduce the pressure of a space in a lead-out flow path 89. However, after a film 83 is opened, a container 73 is brought into close contact with a cap 75 so that this space serves as a sealed space to prevent leakage of ink. Therefore, there is a difficulty in deaerating the lead-out flow path 89 for use as a pressure-reduced space.

In view of the above, the present invention is directed to providing a liquid storage bottle capable of suppressing a decrease in degree of internal pressure reduction with a simple configuration, a liquid storage bottle package, and a method of manufacturing the package.

Now, an embodiment of the present invention is described with reference to the attached drawings. Components that have the same functions are denoted by the same reference symbols throughout the drawings, and repetitive description thereof may be omitted.

Figure 1:
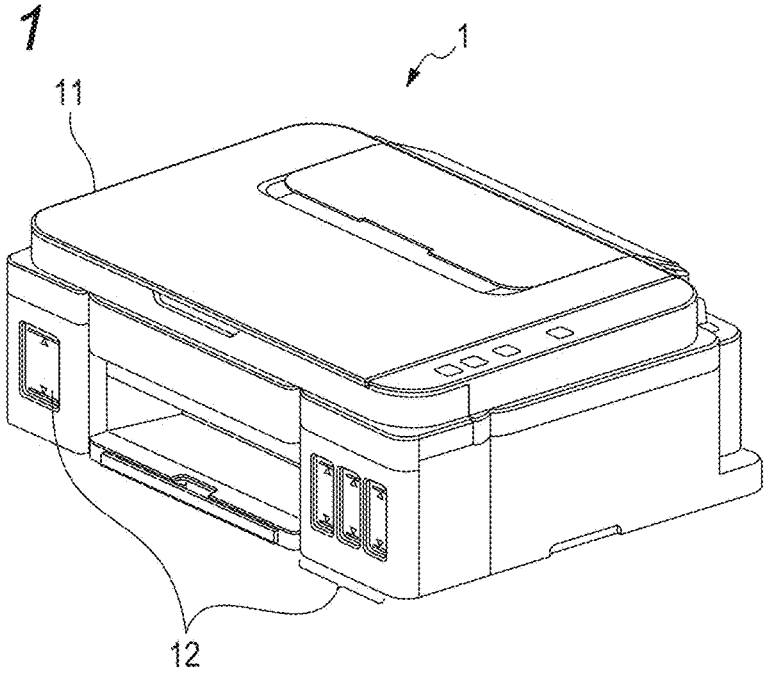
FIG. 1 is a perspective view for illustrating an appearance of a liquid ejection apparatus.

FIG. 1 is a perspective view for illustrating an appearance of a liquid ejection apparatus (inkjet printer) according to the present invention. The liquid ejection apparatus 1 illustrated in FIG. 1 is a serial type inkjet printer. The liquid ejection apparatus 1 illustrated in FIG. 1 includes a housing 11, and large-capacity liquid tanks 12 arranged inside the housing 11. Each of the liquid tanks 12 is configured to store ink which is a liquid to be ejected onto a recording medium (not shown).

Figure 2:
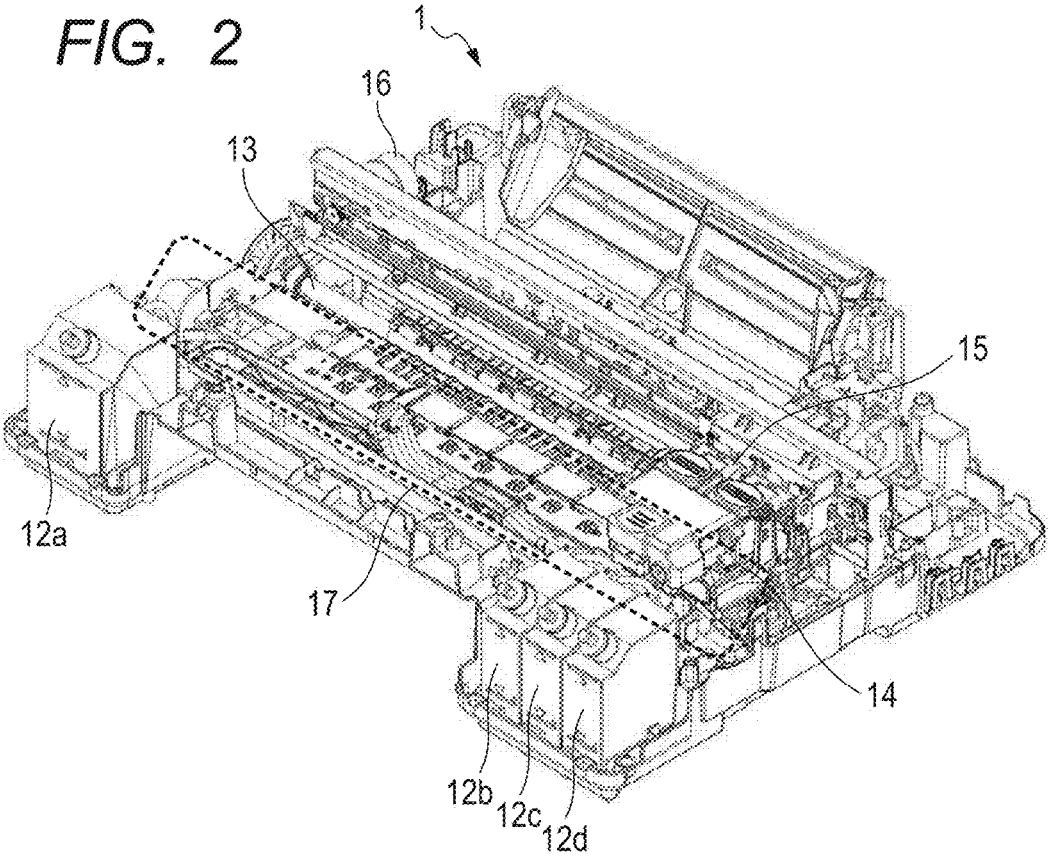
FIG. 2 is a perspective view for illustrating an internal configuration of relevant parts of the liquid ejection apparatus illustrated in FIG. 1.

FIG. 2 is a perspective view for illustrating an internal configuration of relevant parts of the liquid ejection apparatus 1 illustrated in FIG. 1. In FIG. 2, the liquid ejection apparatus 1 includes a conveying roller 13 configured to convey the recording medium (not shown), a carriage 15 in which a recording head (printing head) 14 configured to eject liquid is arranged, and a carriage motor 16 configured to drive the carriage 15. The recording medium is, for example, a sheet and is not particularly limited as long as an image is formed thereon with liquid ejected from the recording head 14.

The conveying roller 13 is driven to intermittently rotate to intermittently convey the recording medium. The carriage 15 reciprocates in a direction orthogonal to a conveying direction of the recording medium conveyed by the conveying roller 13 in accordance with rotary drive of the carriage motor 16. During this reciprocating scanning, liquid is ejected from an ejection port formed in the recording head 14 on the carriage 15 onto the recording medium to record an image or the like on the recording medium.

The liquid is stored in the liquid tanks 12, supplied to the recording head 14 through a liquid flow path 17, and ejected from the recording head 14. In this embodiment, ink of four colors (for example, cyan, magenta, yellow, and black) is used as the liquid, and liquid tanks 12*a* to 12*d* for the respective four colors, which store the ink of the respective colors are arranged as the liquid tanks 12. The liquid tanks 12*a* to 12*d* for the respective colors are arranged on a front surface portion of the liquid ejection apparatus 1 inside the housing 11.

Figure 3:
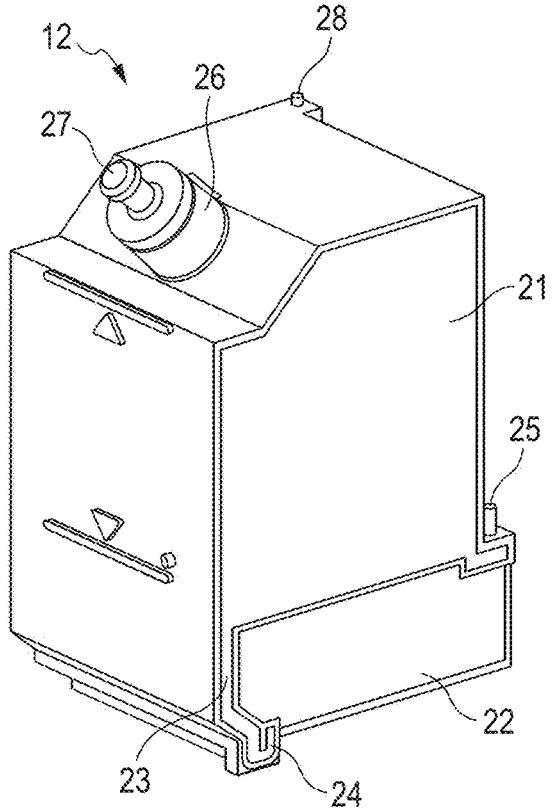
FIG. 3 is a perspective view for illustrating an appearance of a liquid tank.

FIG. 3 is a perspective view for illustrating an appearance of the liquid tank 12. As illustrated in FIG. 3, the liquid tank 12 is formed so that an inside of the liquid tank 12 is partitioned into a storing chamber 21 configured to store liquid, and a buffer chamber 22 configured to store air. A part of a bottom wall of the storing chamber 21 forms a ceiling wall of the buffer chamber 22. The storing chamber 21 and the buffer chamber 22 communicate with each other through a communication flow path 23. The communication flow path 23 is arranged along one side wall of the storing chamber 21. A surface on a side wall side along which the communication flow path 23 is arranged is hereinafter referred to as "front surface." An opening 24 which is an outlet of the communication flow path 23 on the buffer chamber 22 side is formed on a lower side of the buffer chamber 22. A supply port 25, which communicates with the recording head 14 illustrated in FIG. 2 through a tube (not shown) and is configured to supply liquid to the recording head 14, is formed on an end portion of the bottom wall of the storing chamber 21.

A spout 26 which is an opening configured to refill the liquid tank 12 with liquid is formed on top of the liquid tank 12. The spout 26 is formed to be inclined upward in a vertical direction on a front surface side. However, the spout 26 may be formed on top of the liquid tank 12 rather than on an inclined surface. A tank cap 27 configured to seal the storing chamber 21 in the liquid tank 12 can be mounted on the spout 26. In the example of FIG. 3, there is illustrated the liquid tank 12 in a state in which the tank cap 27 is mounted on the spout 26. Further, an open air port 28 configured to allow the buffer chamber 22 to communicate with outside air is formed on top of the liquid tank 12.

With the above-mentioned configuration, the outside air can be introduced into the storing chamber 21 through the open air port 28 in a case where liquid in the storing chamber 21 is consumed in a state in which the storing chamber 21 is sealed with the tank cap 27. Further, even when air in a space above a liquid level in the storing chamber 21 is expanded by atmospheric pressure changes and temperature changes, liquid can be stored in the buffer chamber 22, and hence leakage of the liquid from the open air port 28 can be prevented.

Figure 4:
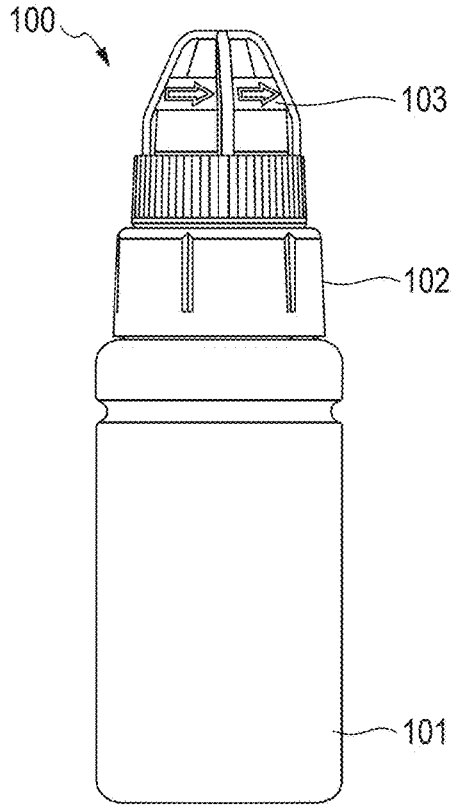
FIG. 4 is a view for illustrating an appearance of a liquid storage bottle.

FIG. 4 is a view for illustrating an appearance of a liquid storage bottle configured to refill the liquid tank 12 illustrated in FIG. 3 with liquid through the spout 26. The liquid storage bottle 100 illustrated in FIG. 4 includes a bottle portion 101 serving as a main body portion configured to store liquid, a nozzle portion 102 connected to the bottle portion 101, and a cap 103 mounted on the nozzle portion 102. The nozzle portion 102 serves as an outlet when the liquid stored in the bottle portion 101 is discharged. The cap 103 is mounted on the nozzle portion 102 to shield the inside of the liquid storage bottle 100 (specifically bottle portion 101) from outside air. The liquid storage bottle 100 has an internal pressure which is reduced to a level lower than atmospheric pressure.

Figure 5:
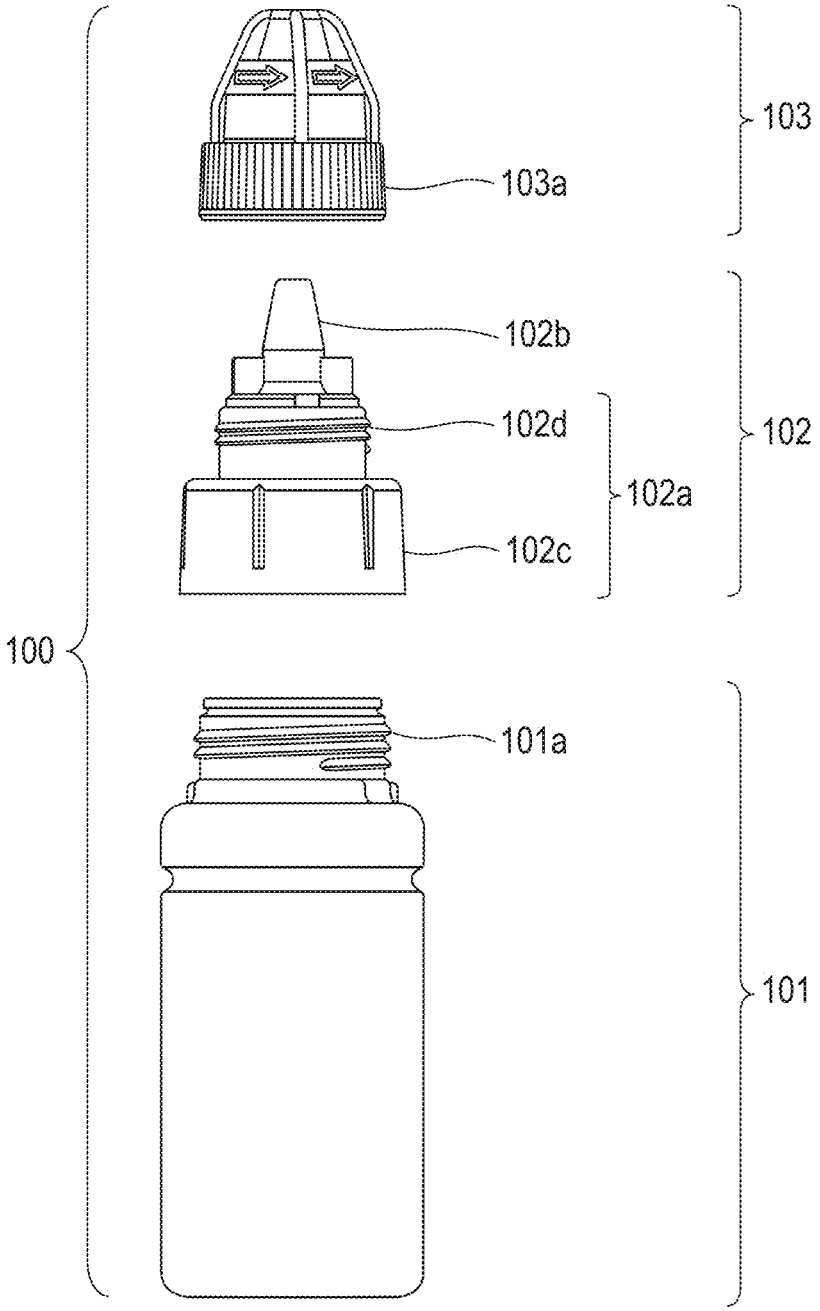
FIG. 5 is a view of a component configuration of the liquid storage bottle illustrated in FIG. 4.

FIG. 5 is a view of a component configuration of the liquid storage bottle 100 illustrated in FIG. 4. As illustrated in FIG. 5, a bottle screw portion 101*a* having a male screw structure on an outer side thereof is formed at an upper part of the bottle portion 101 of the liquid storage bottle 100. The nozzle portion 102 includes a nozzle screw portion 102*a* having a screw structure, and a nozzle 102*b* connected to the nozzle screw portion 102*a* and configured to discharge liquid. The nozzle screw portion 102*a* is separated into a lower screw portion 102*c* having a female screw structure formed on an inner side thereof, and an upper screw portion 102*d* having a male screw structure formed on an outer side thereof. A cap screw portion 103*a* having a female screw structure on an inner side is formed at a lower part of the cap 103.

The cap screw portion 103*a* is screwed onto the upper screw portion 102*d* to mount the cap 103 on the nozzle portion 102. The lower screw portion 102*c* is screwed onto the bottle screw portion 101*a* to connect the nozzle portion 102 to the bottle portion 101.

Now, a configuration of the nozzle portion 102 and the cap 103 is described more in detail.

Figure 6:
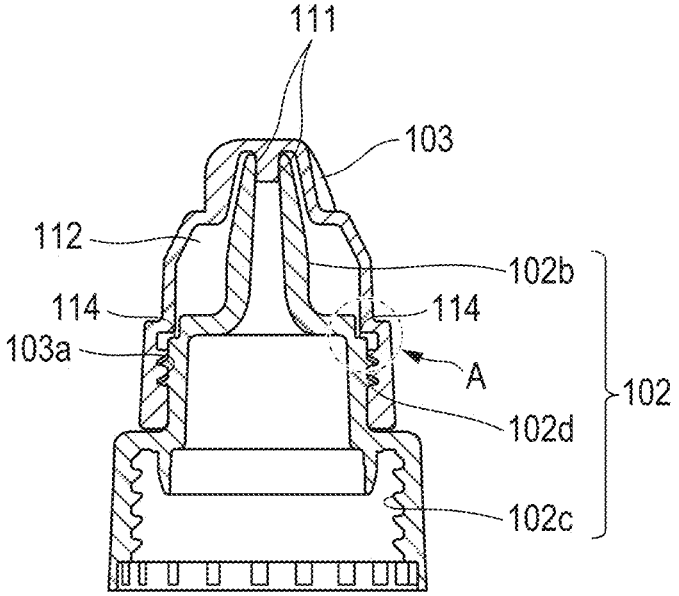
FIG. 6 is a sectional view for illustrating a section of a nozzle portion and a cap.
Figure 7:
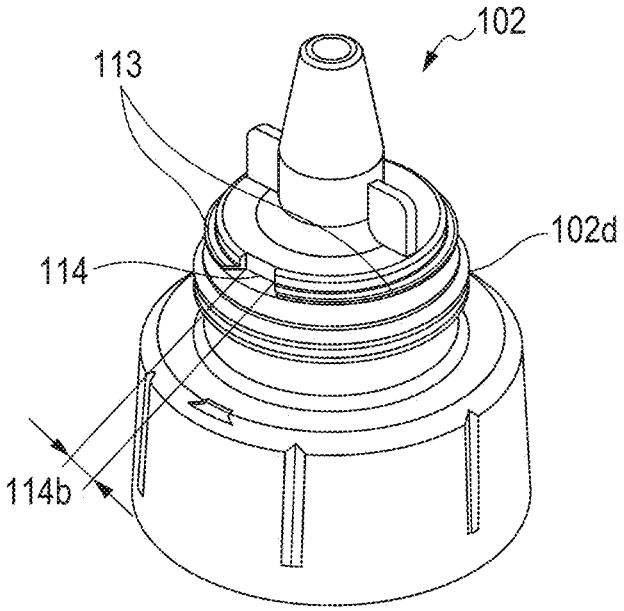
FIG. 7 is a perspective view for illustrating an appearance of the nozzle portion.

FIG. 6 is a sectional view for illustrating a section of the nozzle portion 102 and the cap 103. FIG. 7 is a perspective view for illustrating an appearance of the nozzle portion 102. FIG. 6 is an illustration of a state in which the cap screw portion 103*a* is screwed onto the upper screw portion 102*d* to mount the cap 103 on the nozzle portion 102. As illustrated in FIG. 6, a sealing portion 111 configured to seal the nozzle 102*b* through contact with the cap 103 is formed at a distal end portion of the nozzle 102*b* of the nozzle portion 102. A reduced-pressure holding space 112, which is a space portion configured to store air, is formed between the nozzle 102*b* and the cap 103.

As illustrated in FIG. 6 and FIG. 7, a contact portion 113 which comes into contact with the cap 103 through screwing of the cap screw portion 103*a* onto the upper screw portion 102*d* is formed at an upper end portion, which is an upper side terminal end portion of the upper screw portion 102*d* in the nozzle 102*b*. The contact portion 113 is formed along a periphery of the nozzle portion 102. Two blades (collars) opposed to each other at 180° are formed at a bottom of the nozzle 102*b*, which is above the contact portion 113.

In a case where the cap 103 is fitted onto the nozzle portion 102 while allowing the cap screw portion 103*a* to be screwed onto the upper screw portion 102*d*, the contact portion 113 comes into contact with the cap 103 to complete fitting of the cap 103 onto the nozzle portion 102. It is preferred that the liquid storage bottle 100 be designed so that, during the fitting, the contact portion 113 is brought into contact with the cap 103 after the above-mentioned sealing portion 111 is brought into contact with the cap 103. In this case, flexure of the sealing portion 111 can be prevented. A part of the contact portion 113 has counterbore portions 114, which are groove portions formed by cutting out a part of the contact portion 113.

Figure 8:
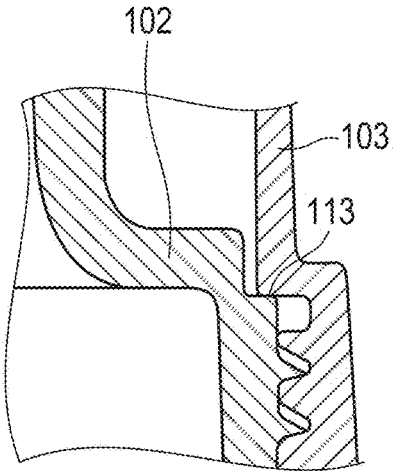
FIG. 8 is an enlarged view of a contact portion and a periphery thereof.
Figure 9:
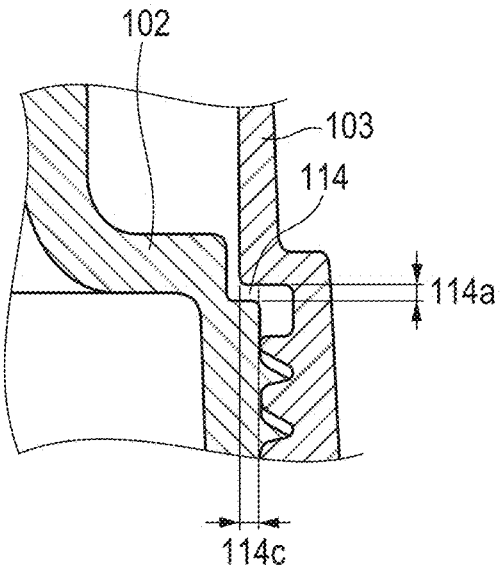
FIG. 9 is an enlarged view of a counterbore portion and a periphery thereof.

FIG. 8 is an enlarged view of the contact portion 113 at a portion where the counterbore portion 114 is not formed, and a periphery thereof. FIG. 9 is an enlarged view of the counterbore portion 114 and a periphery thereof (region surrounded by the dash-dot circle A in FIG. 6).

At the portion where the counterbore portion 114 is not formed as illustrated in FIG. 8, the contact portion 113 is held in contact with the cap 103, and hence there is no gap between the nozzle portion 102 and the cap 103. In contrast, at a portion where the counterbore portion 114 is formed as illustrated in FIG. 9, the counterbore portion 114 causes a gap between the nozzle portion 102 and the cap 103. Therefore, the reduced-pressure holding space 112 communicates with outside of the liquid storage bottle 100 through the counterbore portions 114 and the gap between the cap 103 and the nozzle portion 102 screwed to each other. Thus, the counterbore portions 114 function as communicating portions configured to allow the reduced-pressure holding space 112 to communicate with the outside of the liquid storage bottle 100.

In this embodiment, the contact portion 113 is provided at the upper end portion of the upper screw portion 102*d* along the periphery of the nozzle portion 102, and two counterbore portions 114 are provided at two positions opposed to each other in the contact portion 113. Each of the counterbore portions 114 has a depth 114*a* of from 0.3 mm to 0.7 mm, a width 114*b* of from 3.2 mm to 3.8 mm, and an effective length 114*c* of from 0.6 mm to 1.0 mm. Further, the reduced-pressure holding space 112 has a volume of about 2.6 mL, and the liquid storage bottle 100 has an air volume of about 23 mL. Therefore, a ratio of the volume of the reduced-pressure holding space 112 to the air volume in the liquid storage bottle 100 is about 1:9.

Figure 10:
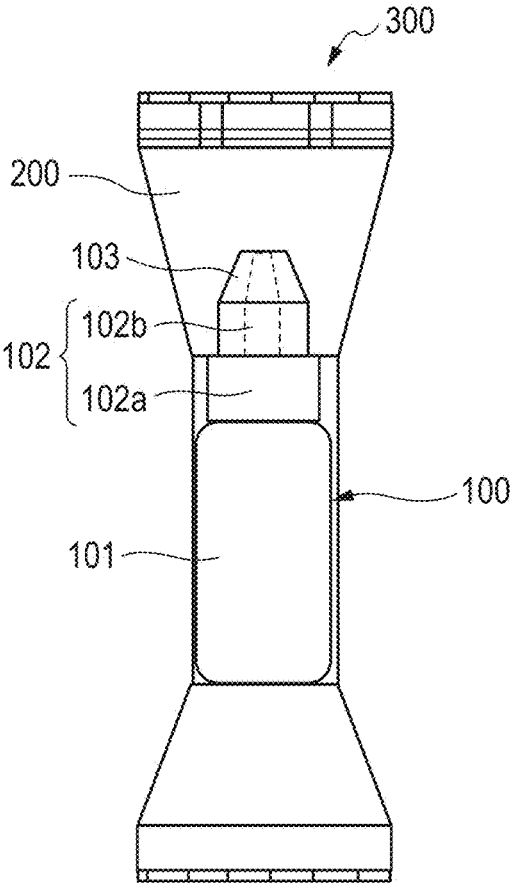
FIG. 10 is an external view for illustrating a liquid storage bottle package.

FIG. 10 is an external view for illustrating a liquid storage bottle package including the packed liquid storage bottle 100. The liquid storage bottle package 300 illustrated in FIG. 10 includes the liquid storage bottle 100, and a pillow bag 200 which is a bag configured to accommodate the liquid storage bottle 100. The pillow bag 200 is formed of a gas barrier material having excellent gas barrier properties. An example of the material for forming the pillow bag 200 includes a film having a vapor-deposited layer made of an inorganic oxide.

In the liquid storage bottle package 300, the liquid storage bottle 100 is accommodated in a state in which an internal air pressure of the pillow bag 200 is reduced to a level lower than atmospheric pressure. The internal pressure of the liquid storage bottle 100 is also in a reduced state as described above, and hence the inside of the liquid storage bottle 100 and the inside of the pillow bag 200 are both in a reduced low pressure state. It is preferred that the inside of the liquid storage bottle 100 have a pressure value larger than a pressure value of the inside of the pillow bag 200.

A method of manufacturing the liquid storage bottle package 300 is described. In order to manufacture the liquid storage bottle package 300, the liquid storage bottle 100 is first prepared, and then the liquid storage bottle 100 is packed in the pillow bag 200 in a pressure-reduced state as illustrated in FIG. 10. Specifically, the liquid storage bottle 100 is accommodated in the pillow bag 200 as illustrated in FIG. 10, and air is sucked out of the pillow bag 200 to reduce the pressure so that the internal pressure value of the pillow bag 200 is equal to or smaller than the internal pressure value of the liquid storage bottle 100. At this time, the reduced-pressure holding space 112 of the liquid storage bottle 100 communicates with the outside through the counterbore portions 114, and hence air inside the reduced-pressure holding space 112 is sucked out through the counterbore portions 114. Therefore, the inside of the reduced-pressure holding space 112 also has the same degree of pressure reduction as the inside of the pillow bag 200.

Therefore, the air volume of air occupying inside the pillow bag 200 can be increased by the volume of the reduced-pressure holding space 112. It is preferred that a ratio of the volume of the reduced-pressure holding space 112 to an air volume in the pillow bag 200 be in a range of from 1:1.6 to 1:3.2. The air volume in the pillow bag 200 as used herein is an air volume inside the pillow bag 200 excluding the volume of the reduced-pressure holding space 112 in a state after packing in a pressure-reduced state.

According to the above-mentioned embodiment, the reduced-pressure holding space 112 between the nozzle portion 102 through which liquid stored in the bottle portion 101 is discharged and the cap 103 mounted on the nozzle portion 102 communicates with the outside of the liquid storage bottle 100. Therefore, the air volume in the pillow bag 200 can be increased without using a complicated structure, such as forming an unfilled chamber in the bottle portion 101. Therefore, a decrease in degree of internal pressure reduction can be suppressed with a simple configuration. In this embodiment, an increase in the number of components can also be suppressed. Further, the reduced-pressure holding space 112 is covered with rigid members such as the nozzle portion 102 and the cap 103, and hence changes in the volume of the reduced-pressure holding space 112 can be suppressed even when the pillow bag 200 has flexure. Therefore, a decrease in the air volume due to the flexure of the pillow bag 200 can be suppressed, and hence a decrease in the degree of pressure reduction in the pillow bag 200 can be suppressed for a long period of time.

As an example, the liquid storage bottle package 300 in this embodiment and a comparative package in which a liquid storage bottle having no reduced-pressure holding space 112 was packed in the pillow bag 200 were evaluated for a decrease in the degree of pressure reduction in the pillow bag 200.

Specifically, the liquid storage bottle package 300 and the comparative package were stored for a long period of time with the internal pressure (gauge pressure) of the pillow bag 200 set to −84 kPa and the air volume in the pillow bag 200 set to 5.9 mL. Then, the internal pressure of the pillow bag 200 was measured for a case where the air volume in the pillow bag 200 was reduced to 4.0 mL due to flexure of the pillow bag 200 over time in each of the liquid storage bottle package 300 and the comparative package. At that time, the internal pressure of the pillow bag 200 in the comparative package was increased up to −76 kPa, whereas the internal pressure of the pillow bag 200 in the liquid storage bottle package 300 was increased only up to −80 kPa. Therefore, it was confirmed that a decrease in the degree of pressure reduction in the pillow bag 200 can be suppressed in the liquid storage bottle package 300.

In the embodiment described above, the illustrated configuration is merely an example, and the present invention is not limited to the configuration. For example, the liquid ejection apparatus 1 is not limited to a serial type inkjet printer but can be appropriately changed. Further, the liquid storage bottle configured to refill the liquid tank of the liquid ejection apparatus 1, which is an inkjet printer, with liquid is used to describe the liquid storage bottle according to the present invention. It is preferred that the liquid storage bottle according to the present invention be for use in such an inkjet printer, but the use is not limited as long as at least liquid can be stored therein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-214403, filed Oct. 30, 2015, which is hereby incorporated by reference herein in its entirety.

What is claimed is:

1. A liquid storage bottle, comprising:

a main body portion configured to store a liquid;

a nozzle portion configured to discharge the liquid stored in the main body portion;

a cap mounted on the nozzle portion;

a space portion formed between the nozzle portion and the cap; and a communicating portion configured to allow the space portion to communicate with outside of the liquid storage bottle, wherein the nozzle portion includes a contact portion which comes into contact with the cap in a state in which the cap is mounted on the nozzle portion, and the communicating portion is a groove portion formed by cutting out a part of the contact portion.

2. The liquid storage bottle according to claim 1, wherein the nozzle portion has a screw structure configured to screw the nozzle portion into the cap, and the contact portion is formed along a periphery of the nozzle portion at an end portion of the screw structure.

3. The liquid storage bottle according to claim 1, wherein the cap is screwed onto the nozzle portion to be mounted on the nozzle portion.

4. A liquid storage bottle for an inkjet printer, comprising:

a main body portion configured to store a liquid;

a nozzle portion configured to discharge the liquid stored in the main body portion;

a cap mounted on the nozzle portion;

a space portion formed between the nozzle portion and the cap; and a communicating portion configured to allow the space portion to communicate with outside of the liquid storage bottle, wherein the nozzle portion includes a contact portion which comes into contact with the cap in a state in which the cap is mounted on the nozzle portion, and the communicating portion is a groove portion formed by cutting out a part of the contact portion, and wherein the liquid stored in the main body portion is charged into a liquid tank of an inkjet printer.

5. The liquid storage bottle for an inkjet printer according to claim 4, wherein the nozzle portion has a screw structure configured to screw the nozzle portion into the cap, and the contact portion is formed along a periphery of the nozzle portion at an end portion of the screw structure.

6. The liquid storage bottle for an inkjet printer according to claim 4, wherein the cap is screwed onto the nozzle portion to be mounted on the nozzle portion.

7. A liquid storage bottle package, comprising:

a liquid storage bottle comprising:

a main body portion configured to store a liquid;

a nozzle portion configured to discharge the liquid stored in the main body portion;

a cap mounted on the nozzle portion;

a space portion formed between the nozzle portion and the cap; and a communicating portion configured to allow the space portion to communicate with outside of the liquid storage bottle, wherein the nozzle portion includes a contact portion which comes into contact with the cap in a state in which the cap is mounted on the nozzle portion, and the communicating portion is a groove portion formed by cutting out a part of the contact portion; and a bag configured to accommodate the liquid storage bottle, wherein the bag has an internal air pressure lower than atmospheric pressure.

8. The liquid storage bottle package according to claim 7, wherein the nozzle portion has a screw structure configured to screw the nozzle portion into the cap, and the contact portion is formed along a periphery of the nozzle portion at an end portion of the screw structure.

9. The liquid storage bottle package according to claim 7, wherein the cap is screwed onto the nozzle portion to be mounted on the nozzle portion.

10. The liquid storage bottle package according to claim 7, wherein the main body portion has an internal air pressure lower than atmospheric pressure and higher than the internal air pressure of the bag.

11. The liquid storage bottle package according to claim 7, wherein a ratio of an air volume in the space portion to an air volume inside the bag excluding the air volume in the space portion is in a range of from 1:1.6 to 1:3.2.

12. The liquid storage bottle package according to claim 10, wherein a ratio of an air volume in the space portion to an air volume inside the bag excluding the air volume in the space portion is in a range of from 1:1.6 to 1:3.2.

13. A method of manufacturing a liquid storage bottle package, comprising:

preparing a liquid storage bottle, the liquid storage bottle comprising:

a main body portion configured to store a liquid;

a nozzle portion configured to discharge the liquid stored in the main body portion;

a cap mounted on the nozzle portion;

a space portion formed between the nozzle portion and the cap; and a communicating portion configured to allow the space portion to communicate with outside, the nozzle portion including a contact portion which comes into contact with the cap in a state in which the cap is mounted on the nozzle portion, and the communicating portion being a groove portion formed by cutting out a part of the contact portion;

accommodating the liquid storage bottle in a bag; and sucking out air inside the bag to reduce an internal air pressure of the bag to a level lower than atmospheric pressure.

14. The liquid storage bottle according to claim 1, wherein the space portion communicates with the outside through the communicating portion and a gap between the nozzle and the cap.

15. The liquid storage bottle for an inkjet printer according to claim 4, wherein the space portion communicates with the outside through the communicating portion and a gap between the nozzle and the cap.

16. The liquid storage bottle package according to claim 7, wherein the space portion communicates with the outside through the communicating portion and a gap between the nozzle and the cap.

17. The method of manufacturing a liquid storage bottle package according to claim 13, wherein the space portion communicates with the outside through the communicating portion and a gap between the nozzle and the cap.

* * * * *